US009153424B2

(12) United States Patent
Jaloszynski et al.

(10) Patent No.: US 9,153,424 B2
(45) Date of Patent: Oct. 6, 2015

(54) CORRECTING TIME-OF-FLIGHT DRIFTS IN TIME-OF-FLIGHT MASS SPECTROMETERS

(75) Inventors: Jonathan Jaloszynski, St. Joseph, MI (US); Peter Markel Willis, Benton Harbor, MI (US)

(73) Assignee: LECO Corporation, St. Joseph, MI (US)

( * ) Notice: Subject to any disclaimer, the term of this patent is extended or adjusted under 35 U.S.C. 154(b) by 0 days.

(21) Appl. No.: 14/000,991

(22) PCT Filed: Feb. 23, 2012

(86) PCT No.: PCT/US2012/026240

§ 371 (c)(1), (2), (4) Date: Oct. 3, 2013

(87) PCT Pub. No.: WO2012/116131

PCT Pub. Date: Aug. 30, 2012

(65) Prior Publication Data

US 2014/0014831 A1 Jan. 16, 2014

Related U.S. Application Data

(60) Provisional application No. 61/445,674, filed on Feb. 23, 2011.

(51) Int. Cl.
*H01J 49/00* (2006.01)
*H01J 49/40* (2006.01)

(52) U.S. Cl.
CPC ..... *H01J 49/0036* (2013.01); *H01J 49/406* (2013.01)

(58) Field of Classification Search
USPC ..... 250/282
See application file for complete search history.

(56) References Cited

U.S. PATENT DOCUMENTS

| | | | | |
|---|---|---|---|---|
| 5,869,240 | A * | 2/1999 | Patterson | 435/6.14 |
| 6,906,320 | B2 * | 6/2005 | Sachs et al. | 250/282 |
| 7,409,298 | B2 * | 8/2008 | Andreev et al. | 702/23 |
| 2005/0023454 | A1 * | 2/2005 | Bateman et al. | 250/288 |
| 2005/0261838 | A1 | 11/2005 | Andreev et al. | |
| 2006/0095212 | A1 | 5/2006 | Kostrzewa et al. | |

(Continued)

FOREIGN PATENT DOCUMENTS

| | | | |
|---|---|---|---|
| DE | 102004017272 | A1 | 11/2004 |
| DE | 102004051043 | A1 | 5/2006 |
| DE | 102007043298 | A1 | 4/2008 |

(Continued)

OTHER PUBLICATIONS

Taylor, J.A., et al., "Implementation and Uses of Automated de Novo Peptide Sequencing by Tandem Mass Spectrometry," Analytical Chemistry, Jun. 2001, vol. 73, No. 11, pp. 2594-2604.

(Continued)

*Primary Examiner* — Phillip A Johnston
(74) *Attorney, Agent, or Firm* — Honigman Miller Schwartz and Cohn LLP

(57) ABSTRACT

A method of correcting time-of-flight drift in a mass spectrometer by identifying mass spectral peaks of ions in spectra, detecting ions having substantially the same mass across spectra, determining a time-of-flight drift of the detected ions, and correcting the time-of-flight drift of the detected ions by applying a correction factor to each respective time-of-flight.

20 Claims, 5 Drawing Sheets

(56) References Cited

U.S. PATENT DOCUMENTS

| | | | |
|---|---|---|---|
| 2008/0243407 | A1 | 10/2008 | Cetto |
| 2009/0048797 | A1 | 2/2009 | Tolmachev et al. |

FOREIGN PATENT DOCUMENTS

| | | | |
|---|---|---|---|
| JP | HEI09080022 | | 3/1997 |
| JP | 2001500606 | A | 1/2001 |
| JP | 2004317509 | A | 11/2004 |
| JP | 2008070122 | A | 3/2008 |
| JP | 2010073331 | A | 4/2010 |
| WO | WO-9636986 | A1 | 11/1996 |
| WO | WO-2008059567 | A1 | 5/2008 |
| WO | WO-2008146440 | A1 | 12/2008 |

OTHER PUBLICATIONS

International Search Report for PCT/US2012/026240, dated Aug. 6, 2012, 4 pages.

Japanese Office Action for related Application No. 2013-555537 dated Jul. 9, 2014.

Chinese Office Action for related Application No. 201280010125.1 dated May 6, 2015.

German Office Action for related Application No. 112012000959.2 dated May 11, 2015.

* cited by examiner

CORRECTING TIME-OF-FLIGHT DRIFTS IN TIME-OF-FLIGHT MASS SPECTROMETERS

CLAIM OF PRIORITY

This application is a 371 of International Application No. PCT/US2012/026240, filed Feb. 23, 2012, which claims priority to Application No. 61/445,674, filed on Feb. 23, 2011, the entire contents of each of the above applications being incorporated herein by reference.

TECHNICAL FIELD

This disclosure relates to correcting time-of-flight drifts in time-of-flight mass spectrometers.

BACKGROUND

Mass spectrometry (MS) is an analytical technique for determining the elemental composition of a sample or molecule, or for elucidating the chemical structures of molecules, such as peptides and other chemical compounds. Mass spectrometry generally includes ionizing chemical compounds to generate charged molecules or molecule fragments and then measuring of their mass-to-charge ratios. In a typical MS procedure, a sample loaded onto a mass spectrometer undergoes vaporization and the components of the sample are ionized to form charged particles (ions). The ions are typically accelerated by an electric field for computation of the mass-to-charge ratio (m/z) of the particles based on the details of motion of the ions as they move through electromagnetic fields. The ions may be sorted by a mass analyzer according to their mass-to-charge ratio (m/z) and detected by a detector for measuring the value of an indicator quantity and providing data for calculating the abundances of each ion present. The calculated mass of each ion may change or drift during operation of the mass spectrometer, due to various factors.

One approach ("Lock Mass") that is used to address the variable mass involves adding one or more known chemicals with known masses into the sample that is being analyzed. This introduction of chemicals will then generate spectral peaks with known masses allowing each mass spectrum to be individually mass calibrated using these spectral peaks. But because the added chemicals are supplied in low quantities to prevent them from interfering with the sample under analysis, poor mass precision for the spectral peaks may result leading to a lower quality mass calibration due to statistical variation. The use of a small number of lock mass can transfer mass variation from the lock mass to all other masses. In the single lock mass case, the lock mass exhibits no mass variation. This makes all other masses within the spectrum more variable.

Also, background calibrant that is used in some known techniques is usually a dilute background so that ionization capacity is not significantly reduced. This low concentration may make for statistically poor drift estimates on individual spectrum.

This method also involves finding the lock mass within the spectrum and because small quantities of the lock mass calibrants are introduced, they can be difficult to identify, especially in rich spectra as other interfering spectral peaks may be near the lock mass peak. This introduces the potential for significant error if the wrong spectral peak is selected as the lock mass peak. Further, this approach requires that the user specify the exact masses of the calibrants and ignores the potentially higher intensity background ions that are often persistent in varying degrees throughout the analysis.

SUMMARY

A time-of-flight mass spectrometer (TOF-MS) can be used to determine a mass of an ion by accelerating the ion along a flight path (e.g., using an electric field), measuring a flight time of the ion, and determining the mass of the ion by using a relationship of the time-of-flight as a function of the mass. Time-of-flight drift can occur due to changes in the testing environment and results in a different time-of-flight measurement for the same mass or ion. Since the time-of-flight is used to calculate the mass of an ion, changes in the measured time-of-flight for an ion of a given mass results in less precise measurements of that ion's mass.

One aspect of the disclosure provides a method of correcting time-of-flight drift in a mass spectrometer by identifying mass spectral peaks of ions in spectra, detecting ions having substantially the same mass across spectra, determining a time-of-flight drift of the detected ions, and correcting the time-of-flight drift of all the ions in the spectrum by applying a correction factor to each respective time-of-flight.

In some implementations, detection of ions having substantially the same mass across spectra may include computing a statistical confidence interval for each identified mass spectral peak's time-of-flight. Mass peaks having overlapping confidence intervals can be assigned the same mass cluster. The confidence interval may be proportional to the expected full width at half height of the mass spectral peak and inversely proportional to the square root of the estimated number of ions contained in the mass peak. The various mass clusters are then used to estimate drift. Grouping the mass peaks together into mass clusters and may be useful for later processing steps.

In some implementations, detection of ions having substantially the same mass across spectra may include identifying first and second spectral peaks corresponding to first and second ions and determining a first time-of-flight and a second time-of-flight of the respective spectral peaks. An inner threshold can be assigned for the spectral peaks, such that the first and second ions are assigned the same mass when the absolute difference of their respective time-of-flights is less than the inner threshold.

In a similar fashion, an outer threshold can be assigned for the spectral peaks; and any ions having an absolute difference in time-of-flights less than the outer threshold and greater than the inner threshold are excluded from any time-of-flight drift calculation and/or correction. The outer threshold prevents ions with strong interferences from participating in the drift correction.

Elimination of time-of-flight (TOF) drift may offer improved mass precision. Drift correction does not necessarily require continuous infusion of a calibrant. TOF drift correction can take advantage of naturally occurring background ions. However if a background calibrant is infused, the TOF drift correction may use ions of the calibrant. Moreover, since many ions can be used, the TOF drift correction may not overcorrect any statistical TOF variations of an ion.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
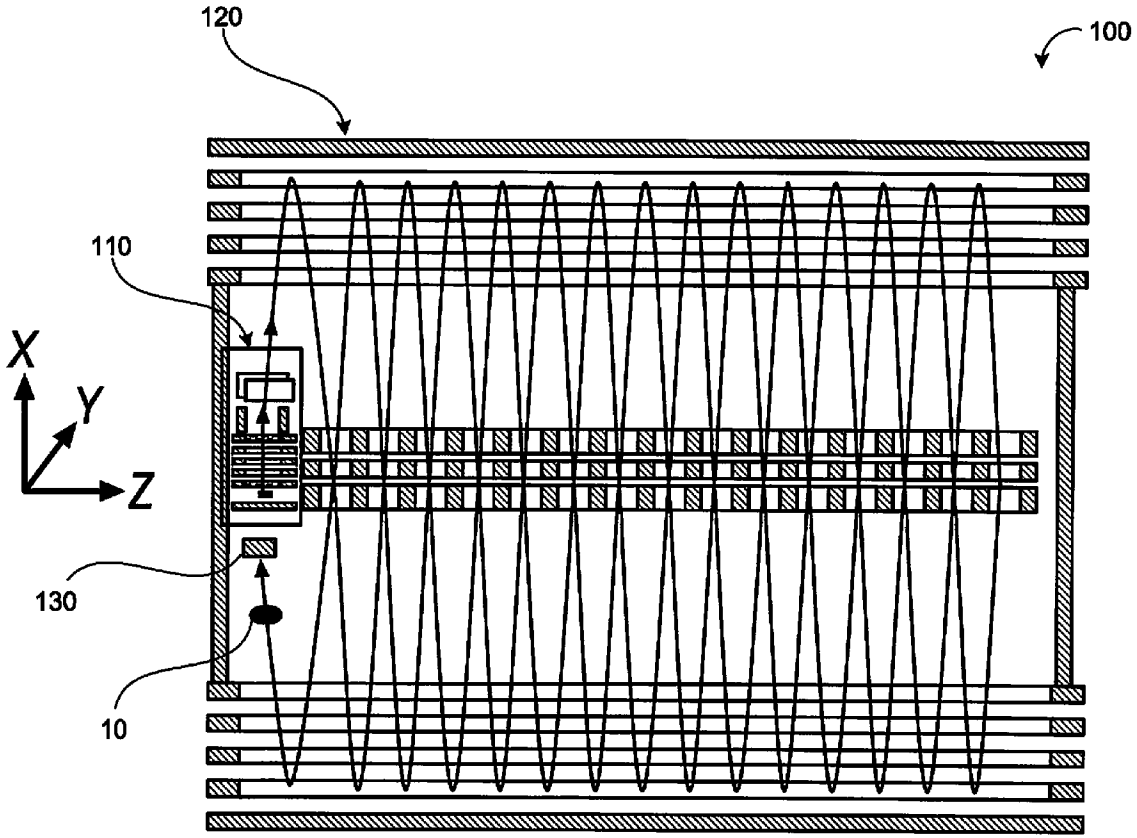
FIG. 1 is a schematic view an exemplary time-of-flight mass spectrometer (TOF-MS) system.

Referring to FIG. 1, in a time-of-flight (TOF) mass spectrometer (MS) 100, a mass M of an ion 10 can be determined by accelerating ion(s) 10 along a flight path (e.g., using an electric field), measuring a flight time T of the ion(s) 10, and determining the mass M of the ion(s) 10 by using a relationship of the time-of-flight T as a function of the mass M (e.g., a mass calibration equation). For example, the time-of-flight T of each ion 10 can be determined using the following equation $$T = \frac{d}{\sqrt{2U}}\sqrt{\frac{M}{z}}, \tag{1}$$

where d is a flight path length of the ion 10, M is a mass of the ion 10, z is a charge of the ion 10, and U is an electric potential difference (voltage) used to accelerate the ion 10. Accelerating ions 10 with a known electric field strength U, results in each ion 10 having the same kinetic energy as any other ion 10 that has the same charge z. Since a velocity of the ion 10 depends on its mass-to-charge ratio (m/z), the time that it subsequently takes for ion 10 to travel along the flight path and reach a detector 130 (i.e., time-of-flight T) can be measured. Heavier ions 10 travel relatively slower and relatively longer flight times T than lighter ions 10.

FIG. 1 provides a schematic view an exemplary time-of-flight mass spectrometer (TOF-MS) system 100 that includes an ion source assembly 110 (e.g., an accumulating ion source with transfer ion optics and an orthogonal accelerator) in communication with a TOF analyzer 120 (e.g., a planar multi-reflecting TOF (M-TOF) analyzer) and a detector 130. The ion source assembly 110 accelerates ions 10 (e.g., packets of ions) through the TOF analyzer 120 having a flight path and corresponding flight path length d and into the detector 130.

TOF drift (and consequently mass drift) can be introduced by various environmental factors, such as thermal expansion and contraction of components of the TOF-MS 100 (e.g., a flight tube) and power supply variations. These factors can result in ion 10, having an initial mass $M_1$ and flight time $T_1$ at the start of an acquisition process, and then have a different flight time $T_2=T_1+E$ at the end of the acquisition process, where E is an error time or drift time due to changes in environmental factors, for example. The second flight time $T_2$ results in a determined second mass $M_2$ different from the first mass $M_1$ during the acquisition process (e.g., due to thermal expansion of the flight tube or TOF analyzer 120), rather than equal to the first mass $M_1$, as an actual mass M of ion 10 has not changed.

In some implementations, the TOF drift biases the TOF of the ions 10 within a spectrum in a uniform way. For example, the TOF drift may scale the TOF of the ions 10 by a factor D. By detecting this drift, and scaling the TOF of the ions 10 by a correction factor C=1/D, the TOF of the ions 10 can be corrected so that the TOF of the ions 10 (and consequently determined masses M) for the first spectrum are on the same scale as subsequent spectra.

TOF drift may cause masses M which are encountered in a spectrum $N_1$ to shift only slightly in subsequent spectra $N_n$. By detecting ions 10 having the same mass M across spectra $N_n$, the amount of TOF drift can be determined and corrected.

Figure 2:
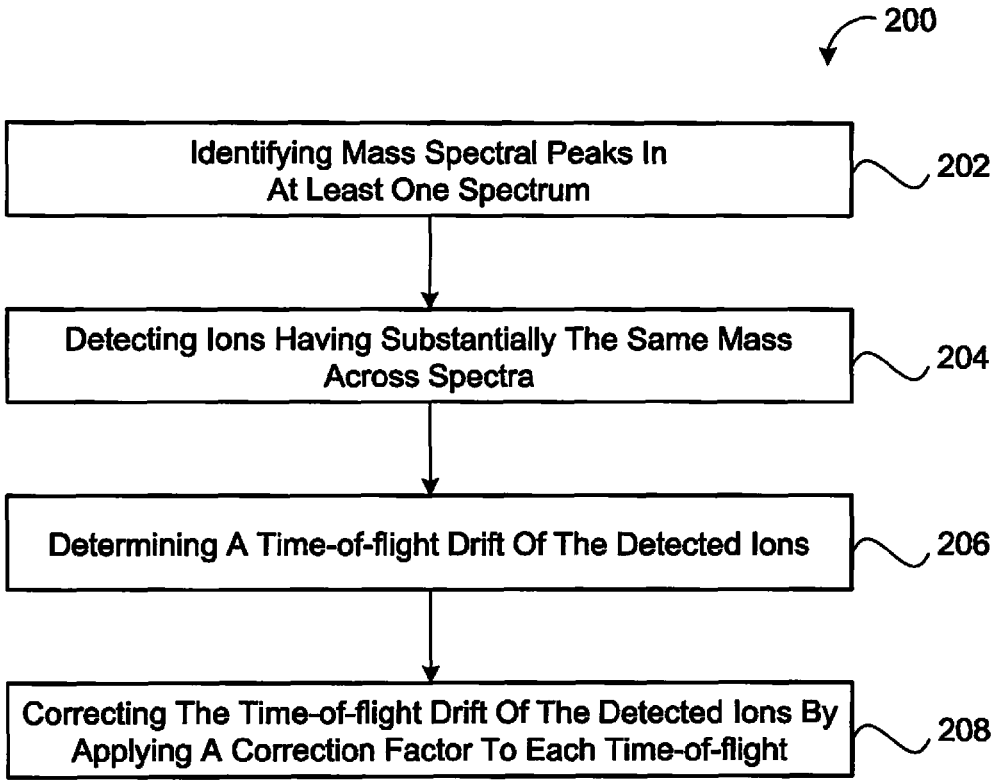
FIG. 2 provides an exemplary arrangement of operations for correcting time-of-flight drift in a TOF-MS.
Figure 3:
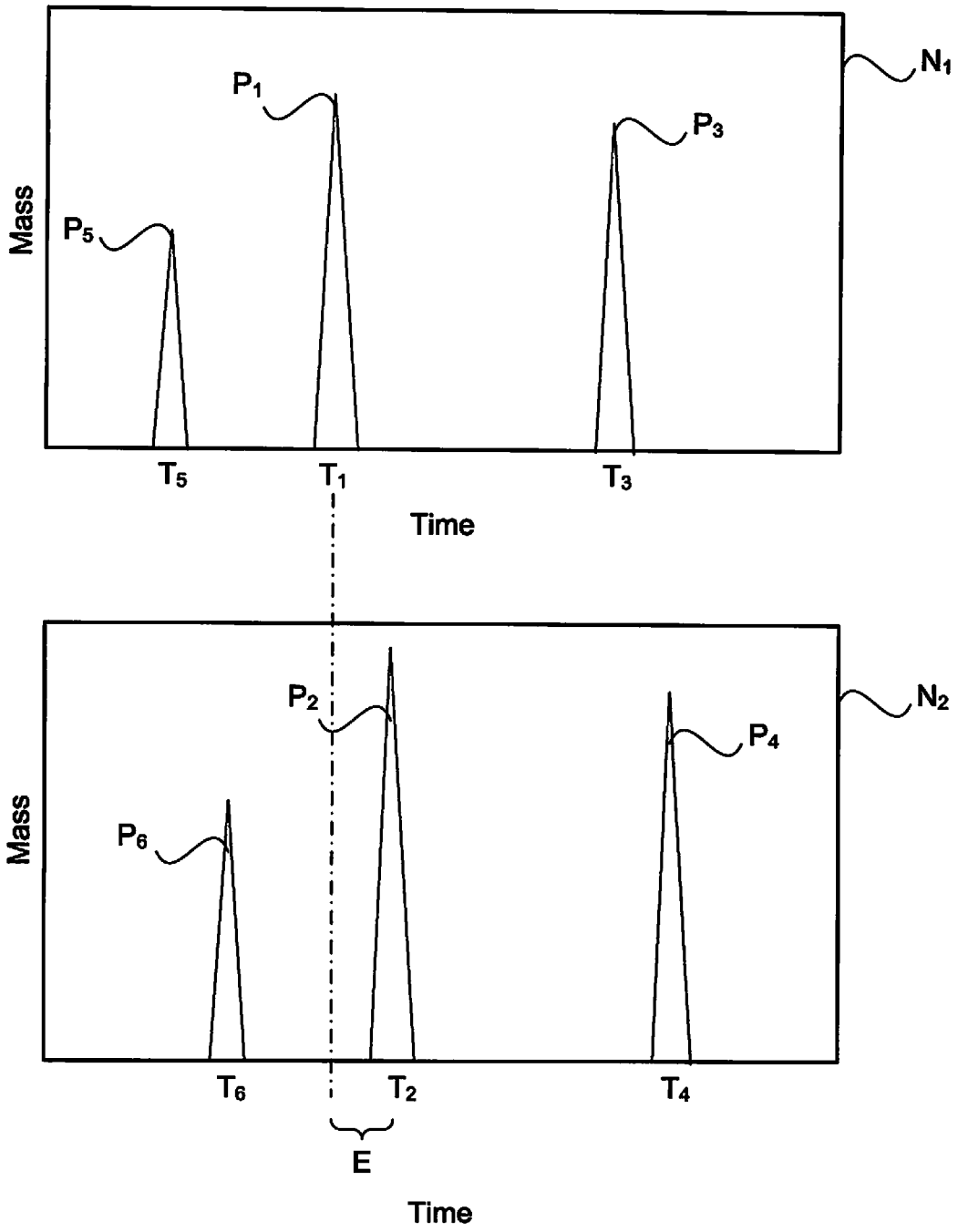
FIG. 3 provides a graphical view of exemplary mass spectral peaks in spectra.

FIG. 2 provides an exemplary arrangement 200 of operations for correcting time-of-flight drift in a TOF-MS 100. The operations include identifying 202 mass spectral peaks P of ions 10 in at least one spectrum N (see e.g., FIG. 3). The operations further include detecting 204 ions 10 having substantially the same mass M across spectra N, determining 206 a time-of-flight drift E of the detected ions 10, and correcting 208 the time-of-flight drift E of the detected ions 10 by applying a correction factor C to each respective time-of-flight T.

Figure 4:
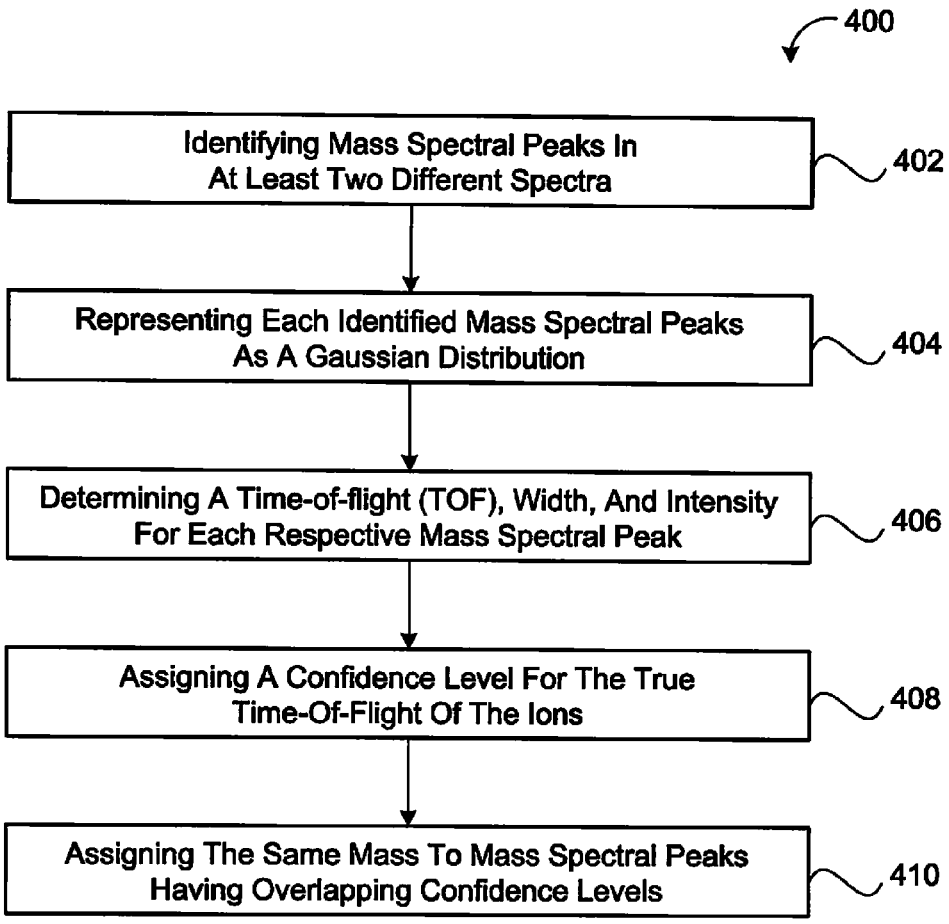
FIGS. 4 and 5 are schematic views of exemplary arrangements of operations for determining if two ions have the same mass for correcting a time-of-flight TOF drift.

FIG. 4 provides an exemplary arrangement 400 of operations for determining if two ions 10 have the same mass M for correcting a TOF drift E. The operations include identifying 402 mass spectral peaks $P_m$ of ions 10 in at least two different spectra $N_n$ and representing 404 each identified mass spectral peak $P_m$ as a Gaussian distribution. A Gaussian distribution is an absolutely continuous probability distribution with zero cumulants of all orders higher than two. The Gaussian distribution may be represented by the following equation:

$$f(x) = \frac{1}{\sqrt{2\pi\sigma^2}} e^{-\frac{(x-\mu)^2}{2\sigma^2}} \tag{2}$$

where $\mu$ and $\sigma^2$ are the mean and the variance of the distribution. The Gaussian distribution with $\mu=0$ and $\sigma^2=1$ is called the standard normal distribution. The operations further include determining 406 a time-of-flight (TOF), width, and intensity for each respective mass spectral peak $P_m$, and assigning 408 a confidence level for the true TOF T of the ions 10. For overlapping confidence levels, the operations include assigning 410 the same mass M to respective mass spectral peaks $P_m$ and corresponding ions 10. The confidence level may be proportional to a deviation from the mean of the Gaussian distribution. For examples, mass spectral peaks $P_m$ within one standard deviation of the peak or mean have a higher confidence level than mass spectral peaks $P_m$ within two standard deviations.

Figure 5:
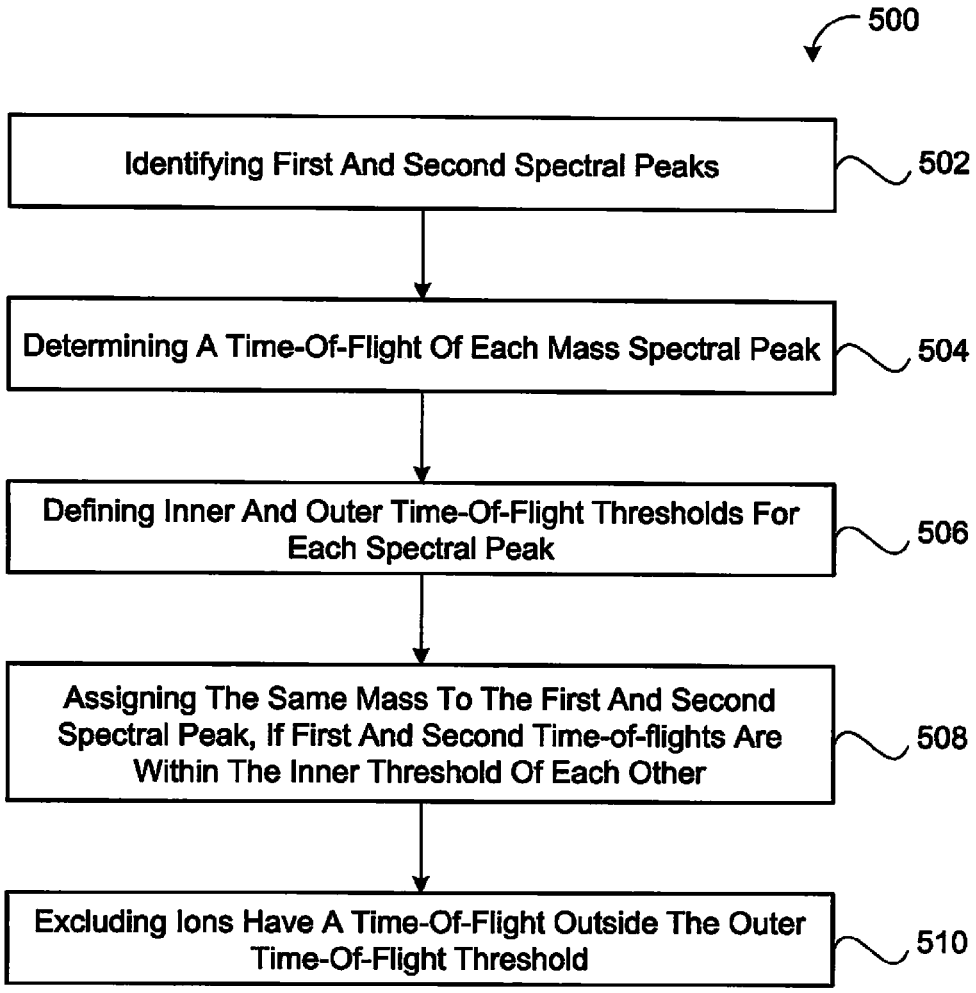

FIG. 5 provides an exemplary arrangement 500 of operations for determining if two ions 10 have the same mass M for correcting a TOF drift E. The operations include identifying 502 first and second spectral peaks $P_1$, $P_2$ (see e.g., FIG. 3) and determining 504 a first TOF $T_1$ and a second TOF $T_2$ of the respective spectral peaks $P_1$, $P_2$. The operations include defining 506 an inner threshold I and an outer threshold O for the spectral peaks $P_1$, $P_2$. The operations further include assigning 508 the same mass M to the first and second spectral peak $P_1$, $P_2$, if first and second time-of-flights $T_1$ and $T_2$ are within the inner threshold I of each other (e.g., $abs(T_1-T_2)<I$). The outer threshold O can be used to exclude interferences. For example, if there exists a third ion 10 having a corresponding TOF $T_3$ in either spectrum N such that $abs(T_1-T_3)<O$ or $abs(T_2-T_3)<O$, then the operations may include excluding 310 the third ion 10 from the TOF drift correction.

In some implementations, operations for correcting TOF drift includes selecting ions 10 having interferences or inaccuracies and eliminating those ions 10 from the drift correction calculation. For example, the operations may include selecting qualifying ion pairs for the N tallest ions 10, and excluding relatively less intense ions 10, which have relatively more noise in associated TOF measurements. The operations may include determining an estimated TOF drift E for each ion pair and eliminating estimated TOF drifts E significantly different (e.g., outliers) from other estimated TOF drifts E in this set of estimates. For example, the operations may include eliminating estimated TOF drifts E outside one standard deviation or one average absolute deviation from the average or mean estimated TOF drift E of the set of estimated TOF drifts E. The operations further include combining the remaining estimated TOF drifts for determining a final TOF drift estimate (e.g., by determining an arithmetic mean or median of the TOF drifts).

Historical mass spectral data can be maintained within the TOF-MS 100. Ions 10 with greater intensity or persistence may be selected for acquisition and storage (e.g., in memory) of corresponding spectral data as historical data. When correcting TOF drift for ions 10 within a new spectrum, matches can be determined between the historical spectral data and newly acquired spectral data. The matching historical spectral data can be used to calculate a drift correction slope, which can be applied to the new spectrum. TOF and/or intensity differences can be determined between a first ion 10*a* in the historical spectral data and a second ion 10*b* in the new spectrum. A match between the first ion 10*a* and the second ion 10*b* may exist when the determined TOF and/or intensity differences are within a threshold. Moreover, ions 10 from the newly acquired spectrum may be selected for addition to the historical spectrum (e.g., matching ions 10). Ions 10 which have not been seen for some time can be aged out of the historical spectral data.

In some implementations, the TOF-MS 100 identifies ions 10 for TOF drift correction without user specification or selection of particular ion masses for TOF drift correction. The user may specify a selection criterion to limit which ion masses are used for TOF drift correction. Mass ranges and/or intensity limits can be used to exclude certain ions 10 from being used for drift correction.

Ions 10 selected for drift correction can be updated dynamically, thus allowing execution of a TOF drift correction routine(s) using non-background ions 10. A requirement for using an ion 10 for a TOF drift correction routine may including encountering the ion 10 in a number of adjacent spectra. Ions 10 from chromatographic peaks can be used for this purpose as well. When the chromatographic peak has completely eluted, the drift correction algorithm or routine can use another ion 10.

The TOF drift correction routine can be extended across multiple samples. If multiple samples have a similar set of background ions 10, the background ions 10 can be identified and the samples can be corrected to use the same TOF scale (and consequently mass calibration) as a single master sample. Moreover, mass calibration via the TOF drift correction routine can be executed across multiple samples.

Saturated ion peaks may be unsuitable for drift correction. These ions can have unpredictable TOFs due to peak distortions from saturation. This can lead to errors being introduced into the drift correction factor. In some implementations, these saturated ion peaks can be ignored by the drift correction algorithm, resulting in higher quality corrections.

Low level ion peaks may be unsuitable for drift correction. These ions can have TOFs with significant variation because they represent very few individual ion measurements. In some implementations, low level ion peaks can be ignored by the drift correction. Furthermore, spectra consisting solely of low level ion peaks can cause the drift correction algorithm to deactivate. This can avoid introducing more error than is corrected.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system can include clients and servers. A client and server are generally remote from each other and typically interact through a communication network. The relationship of client and server arises by virtue of computer programs running on the respective computers and having a client-server relationship to each other.

Implementations of the subject matter and the functional operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer program products, i.e., one or more modules of computer program instructions encoded on a computer readable medium for execution by, or to control the operation of, data processing apparatus. The computer readable medium can be a machine-readable storage device, a machine-readable storage substrate, a memory device, a composition of matter effecting a machine-readable propagated signal, or a combination of one or more of them. The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them. A propagated signal is an artificially generated signal, e.g., a machine-generated electrical, optical, or electromagnetic signal, that is generated to encode information for transmission to suitable receiver apparatus.

A computer program (also known as a program, software, software application, script, or code) can be written in any form of programming language, including compiled or interpreted languages, and it can be deployed in any form, including as a stand alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Beneficial features of the described implementation include, among others: (i) a reduced demand on related power supplies and increased thermal stability, (ii) background ions do not have to be specified, (iii) the approach allows the combination multiple persistent masses to calculate a weighted estimate of the drift correction and qualifies masses before they are used in the weighted estimate, (iv) the approach allows correction to be applied in real-time and the correction rate to be matched to spectral reporting rate, (v) the drift correction can be carried over to the next analysis so that the mass calibration is preserved as much as possible between analyses, and (vi) the persistent masses can be retained in memory so that if a segment of data has low ion abundance such that the drift correction is disabled, it can be re-activated when sufficient abundance is restored and locked back into the previous spectra.

While this specification contains many specifics, these should not be construed as limitations on the scope of the invention or of what may be claimed, but rather as descriptions of features specific to particular implementations of the invention. Certain features that are described in this specification in the context of separate implementations can also be implemented in combination in a single implementation. Conversely, various features that are described in the context of a single implementation can also be implemented in multiple implementations separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, various forms of the flows shown above may be used, with steps re-ordered, added, or removed. Also, although several applications of the systems and methods have been described, it should be recognized that numerous other applications are contemplated. Accordingly, other implementations are within the scope of the following claims.

What is claimed is:

1. A method of correcting time-of-flight drift in a mass spectrometer, the method comprising:

identifying mass spectral peaks of ions in spectra;

detecting ions having substantially the same mass across spectra by representing each identified mass spectral peak as a probability distribution, determining at least one of a time-of-flight and an intensity of each respective mass spectral peak, assigning a confidence interval for a time-of-flight of the ion, and assigning the same mass to ions of respective mass spectral peaks having overlapping confidence intervals;

determining a time-of-flight drift of the detected ions; and correcting the time-of-flight drift of the detected ions by applying a correction factor to each respective time-of-flight.

2. The method of claim 1, wherein the TOF confidence interval that is assigned at the step of detecting ions having substantially the same mass across spectra is inversely proportional to the square root of the spectral peak area.

3. A method of correcting time-of-flight drift in a mass spectrometer, the method comprising:

identifying mass spectral peaks of ions in spectra;

detecting ions having substantially the same mass across spectra by identifying first and second spectral peaks corresponding to first and second ions, determining a first time-of-flight and a second time-of-flight of the respective spectral peaks, assigning an inner threshold for the spectral peaks, and assigning the same mass to the first and second ions when the first and second time-of-flights have an absolute difference less than the inner threshold;

determining a time-of-flight drift of the detected ions; and correcting the time-of-flight drift of the detected ions by applying a correction factor to each respective time-of-flight.

4. The method of claim 3, further comprising:

assigning an outer threshold for the spectral peaks; and excluding any ions having a time-of-flight having an absolute difference less than the outer threshold.

5. The method of claim 1, wherein the time-of-flight correction factor comprises a scaling factor.

6. The method of claim 1, further comprising determining the correction factor based on ions having substantially similar time-of-flight drifts.

7. The method of claim 6, further comprising determining an average of the determined time-of-flight drifts and eliminating an ion from determining the correction factor that has a determined time-of-flight drift different by a threshold from the average time-of-flight drift.

8. The method of claim 1, further comprising storing at least one of time-of-flight, intensity, time-of-flight drift, and mass as historical data.

9. The method of claim 1, further comprising comparing at least one of time-of-flight, intensity, time-of-flight drift, and mass of a target ion with the historical data for determining at least one of time-of-flight, intensity, time-of-flight drift, and mass of the target ion.

10. The method of claim 1, wherein the identifying step further comprises the sub-step of ignoring ion peaks with intensities indicating at least one or both of (i) saturation and (ii) poor ion statistics.

11. The method of claim 1, wherein the probability distribution is a Gaussian distribution.

12. A method of correcting time-of-flight drift in a mass spectrometer, the method comprising:

identifying mass spectral peaks of ions in spectra;

determining a confidence interval of the mass for one or more identified mass spectral peaks;

detecting ions having substantially the same mass across spectra;

determining a time-of-flight drift of the detected ions; and correcting the time-of-flight drift of the detected ions by applying a correction factor to each respective time-of-flight.

13. The method of claim 12, further comprising:

assigning a mass cluster to the one or more identified mass spectral peaks, wherein mass spectral peaks with overlapping confidence intervals across spectra are assigned to the same mass cluster.

14. The method of claim 12, wherein detecting ions having substantially the same mass across spectra comprises selecting ions having at least one of a substantially similar time-of-flight and a substantially similar intensity.

15. The method of claim 14, wherein a difference between at least one of a time-of-flight and an intensity of selected ions is within a threshold value, and wherein the threshold value is determined based upon values corresponding to the confidence interval.

16. The method of claim 12, further comprising:

assigning a mass cluster to the one or more identified mass spectral peaks, wherein overlapping mass spectral peaks are assigned to the same mass cluster.

17. The method of claim 16, wherein the confidence interval is proportional to an expected full width at half height of the mass spectral peak.

18. The method of claim 16, wherein the confidence interval is inversely proportional to the square root of an estimated number of ions contained in the mass peak.

19. The method of claim 12, further comprising:

assigning a mass cluster to the one or more identified mass spectral peaks when the probability is high that the two spectral peaks belong to the same compound.

20. The method of claim 19, wherein the assignment step is based on the determination of the confidence interval of the mass for the one or more identified mass spectral peaks.

* * * * *